US010175649B1

(12) United States Patent
Stafford et al.

(10) Patent No.: US 10,175,649 B1
(45) Date of Patent: Jan. 8, 2019

(54) NEGATIVE PRESSURE ELECTROSTATIC PROCESS UNIT FOR PRINTERS AND MULTIFUNCTION PERIPHERALS

(71) Applicants: Kabushiki Kaisha Toshiba, Minato-ku (JP); Toshiba TEC Kabushiki Kaisha, Shinagawa-ku (JP)

(72) Inventors: Donald W. Stafford, Lexington, KY (US); William M. Connors, Lexington, KY (US)

(73) Assignees: Kabushiki Kaisha Toshiba, Minato-ku (JP); Toshiba TEC Kabushiki Kaisha, Shinagawa-ku (JP)

( * ) Notice: Subject to any disclaimer, the term of this patent is extended or adjusted under 35 U.S.C. 154(b) by 0 days.

(21) Appl. No.: 15/714,702

(22) Filed: Sep. 25, 2017

(51) Int. Cl.
*G03G 21/20* (2006.01)
*G03G 21/00* (2006.01)

(52) U.S. Cl.
CPC ..... *G03G 21/206* (2013.01); *G03G 21/0011* (2013.01); *G03G 21/0076* (2013.01)

(58) Field of Classification Search
USPC ..... 399/91–93, 98–101, 107, 110, 111
See application file for complete search history.

(56) References Cited

U.S. PATENT DOCUMENTS 8,488,989 B2 * 7/2013 Ukai ..... G03G 21/20 399/92
8,712,278 B2 * 4/2014 Yamaguchi ..... G03G 15/2017 399/92

FOREIGN PATENT DOCUMENTS

JP 06035251 * 2/1994

* cited by examiner

*Primary Examiner* — Hoan Tran
(74) *Attorney, Agent, or Firm* — Ulmer & Berne LLP

(57) ABSTRACT

A system and method for removing toner and particles from a developer cavity of an electrostatic process unit of a toner-based printer includes a filter displaced over at least a portion of the developer cavity, and a fan configured to draw a volume of air through the filter from the portion of the developer cavity adjacent to the filter. The fan is coupled to the photoconductive drum of the electrostatic process unit and rotates when the photoconductive drum rotates. The rotation of the fan generates a negative pressure on the filter which draws the volume of air through the filter. The filter removes airborne toner and particles from the volume of air. The toner and particles are removed from the electrostatic process unit by an associated auger.

20 Claims, 4 Drawing Sheets

NEGATIVE PRESSURE ELECTROSTATIC PROCESS UNIT FOR PRINTERS AND MULTIFUNCTION PERIPHERALS

TECHNICAL FIELD

This application relates generally to filtering suspended particulate from developer cavities of toner-based electrophotographic printers and multifunction peripherals, and more particularly to fan and filter for removing residual toner and paper dust from a developer cavity of an electrostatic process unit of a printer.

BACKGROUND

Document processing devices include printers, copiers, scanners and e-mail gateways. More recently, devices employing two or more of these functions are found in office environments. These devices are referred to as multifunction peripherals (MFPs) or multifunction devices (MFDs). As used herein, MFP means any of the forgoing.

An electrostatic process unit, or EPU, in many printers and multifunction peripherals assists in performing the printing functions. The EPU is also referred to as an electrographic processing unit. The EPU typically comprises a photoconductive drum, and a developer roller, and can include a charge unit, a toner hopper, a semiconductor laser, and developer among other components as would be known in the art. The EPU can be configured as a field replaceable unit or can be part of a self-contained compact cartridge that includes the toner. Using magnetic and electrostatic forces, the developer roller and the photoconductive drum transfer toner from a toner hopper to a sheet of paper where it is fused by heat to the paper. After the photoconductive drum transfers toner to the paper, a cleaner blade in the EPU removes residual toner and paper dust from the photoconductive drum.

However, residual toner and paper dust can be suspended in the air within the EPU, for example within the developer cavity of the EPU. Toner and paper dust, if not entirely removed can leak into other areas of the EPU, particularly when suspended in air. The toner and paper dust can contaminate other EPU components such as the primary charge roller or the corona components, settle on the photoconductive drum and degrade future print jobs, and interfere with the proper operation of an electrostatic process unit.

SUMMARY

Figure 1:
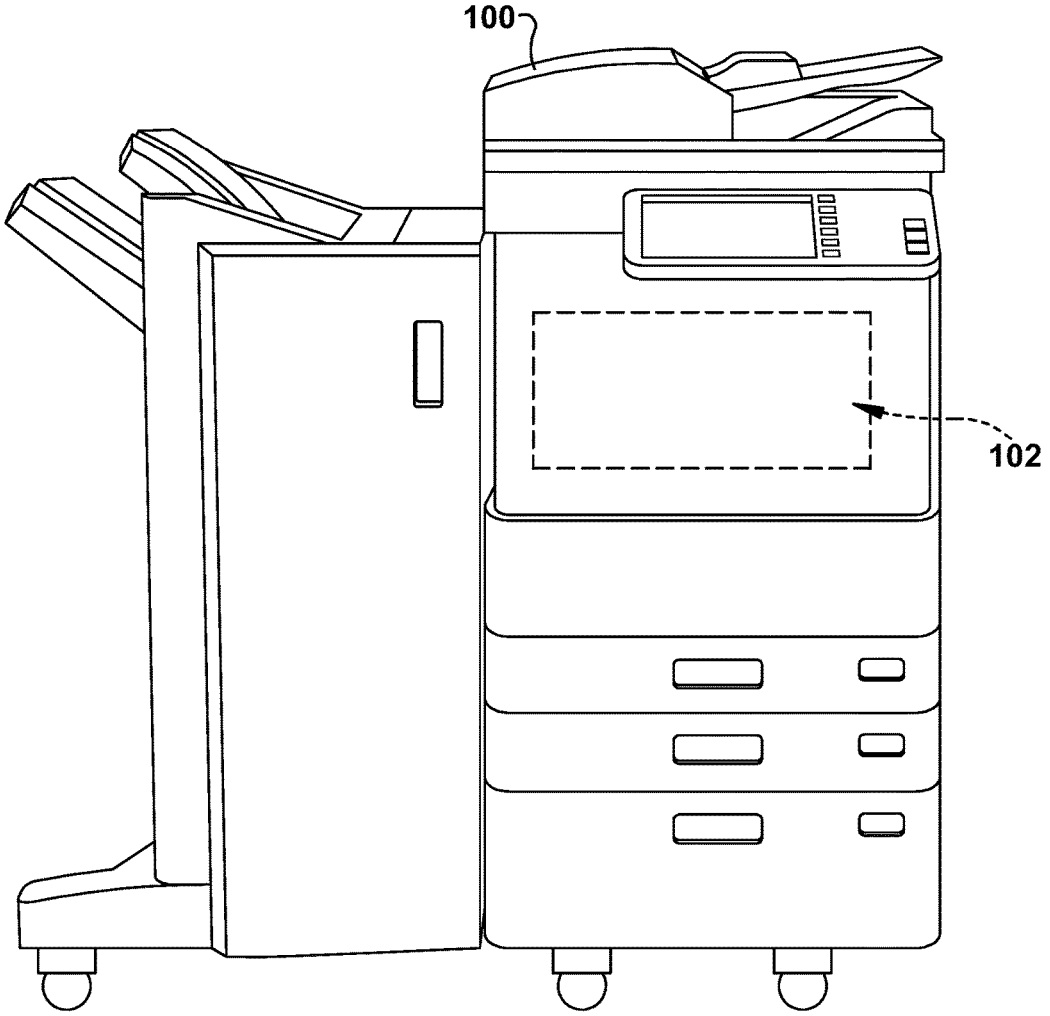
FIG. 1 is a block diagram of a multifunction peripheral.

In an example embodiment, an apparatus includes a filter and a fan. The filter is configured to trap particulate, such as toner, paper dust, particles of calcium carbonite, and submicron particles, in the developer cavity of an electrostatic process unit while allowing air from the developer cavity to pass through. The filter has a first side that is coupled to all of, or a portion of, the developer cavity of the electrostatic process unit. The filter has a second side that is in communication with the fan so that the fan generates a negative pressure on the second side of the filter and draws air from the developer cavity through the filter. A conduit such as a plastic or metal pipe can be used to guide the flow of air between the fan and the filter. The fan is coupled to the drum assembly of the electrostatic process unit. The drum assembly rotates which causes the fan to rotate in coordination with the drum assembly and generate the negative pressure. The fan can be an axial-flow fan, a centrifugal fan, or a cross-flow fan. The fan can be coupled to a drive shaft associated with a photoconductive drum of the electrostatic process unit, for example through gears, a belt, or by being mounted directly on the drive shaft so that the fan is coaxial with the photoconductive drum. In a configuration, the filter is coupled to a closed area of the developer cavity associated with the cleaner blade, recovery blade, and auger. The filter can be designed to assist in depositing some of the trapped particulate in proximity to the auger for removal. The electrostatic process unit can include a developer roller, a photoconductive drum, a doctor blade, and a cleaner blade among other suitable components. The electrostatic process unit can be coupled with the associated developer unit.

In an example embodiment, an electrostatic process unit includes a photoconductive drum that selectively attracts toner from a developer roller and deposits the attracted toner onto paper, and a cleaner blade that removes residual toner left on the photoconductive drum that was not deposited onto the paper, and a filter. The filter has a first side displaced over all of, or a portion of, the developer cavity, and a second side that is in communication with a negative pressure generating element, such as a fan. The filter is configured to trap particulate, such as toner, paper dust, and submicron particles of calcium carbonate, in the developer cavity while allowing air from the developer cavity to be drawn through the filter in response to the negative pressure applied to the second side of the filter. The fan can be coupled to, and rotate in coordination with, the photoconductive drum to generate the lower pressure on the second side of the filter. The fan can be an axial-flow fan, a centrifugal fan, or a cross-flow fan and mounted directly on a drive shaft associated with the photoconductive drum such that the fan, drive shaft, and photoconductive drum share the same axis. The electrostatic process unit can include a conduit to guide the flow of air between the fan and the filter. The electrostatic process unit can include a recovery blade that traps the residual toner in a closed portion of the developer cavity, and an auger to remove the trapped toner from the electrostatic process unit. The filter can be coupled to the closed portion of the developer cavity and deposit trapped toner in proximity to the auger for removal.

In an example embodiment, a method includes applying a negative pressure to a filter that is positioned over at least a portion of a developer cavity of an electrostatic process unit, drawing a volume of air from the developer cavity through the filter, and filtering particulate suspended in the volume of air. The method can include rotating a photoconductive drum and a fan that can be mounted coaxially with the photoconductive drum. Rotating the photoconductive drum causes the fan to rotate and generate the negative pressure that is applied to the filter. The method can include rotating an auger in the electrostatic process unit to remove particulate from the developer cavity.

DETAILED DESCRIPTION

The systems and methods disclosed herein are described in detail by way of examples and with reference to the figures. It will be appreciated that modifications to disclosed and described examples, arrangements, configurations, components, elements, apparatuses, devices methods, systems, etc. can suitably be made and may be desired for a specific application. In this disclosure, any identification of specific techniques, arrangements, etc. are either related to a specific example presented or are merely a general description of such a technique, arrangement, etc. Identifications of specific details or examples are not intended to be, and should not be, construed as mandatory or limiting unless specifically designated as such.

In toner-based electro-photographic printers, toner is picked up by a magnetic developer roller in an electrostatic process unit, or EPU, from a toner hopper. A precise leveling blade called a doctor blade is positioned close to the magnetic developer roller and removes excess toner to ensure there is only a thin even layer of toner on the magnetic developer roller. The magnetic developer roller rotates towards a photoconductive drum onto which an electric charge has been applied, and toner from the magnetic developer roller is transferred to the photoconductive drum in accordance with a desired image to be printed. The toner is then transferred from the photoconductive drum to paper via a transfer belt and fused with the paper to form a printed page. Residual toner that is left on the photoconductive drum is removed by a cleaner blade or wiper blade into a waste bin. In addition to residual toner, the photoconductive drum can pick up paper dust from the paper. The paper dust can include submicron sized calcium carbonate commonly used in a wide range of papers.

Residual toner and paper dust, if not removed, can inadvertently end up on the printed page or settle as dust on other EPU components. Toner dust and other particles can potentially interfere with the proper operation of the EPU or contaminate future print jobs. Therefore removing waste toner and paper dust can improve the quality of printed images, reduce waste, and lower maintenance costs.

With reference to FIG. 1, an example multifunction peripheral (MFP 100) is presented. The MFP 100 includes electrostatic-based, or toner-based, printing hardware 102 for performing printing operations as would be understood in the art.

Figure 2A:
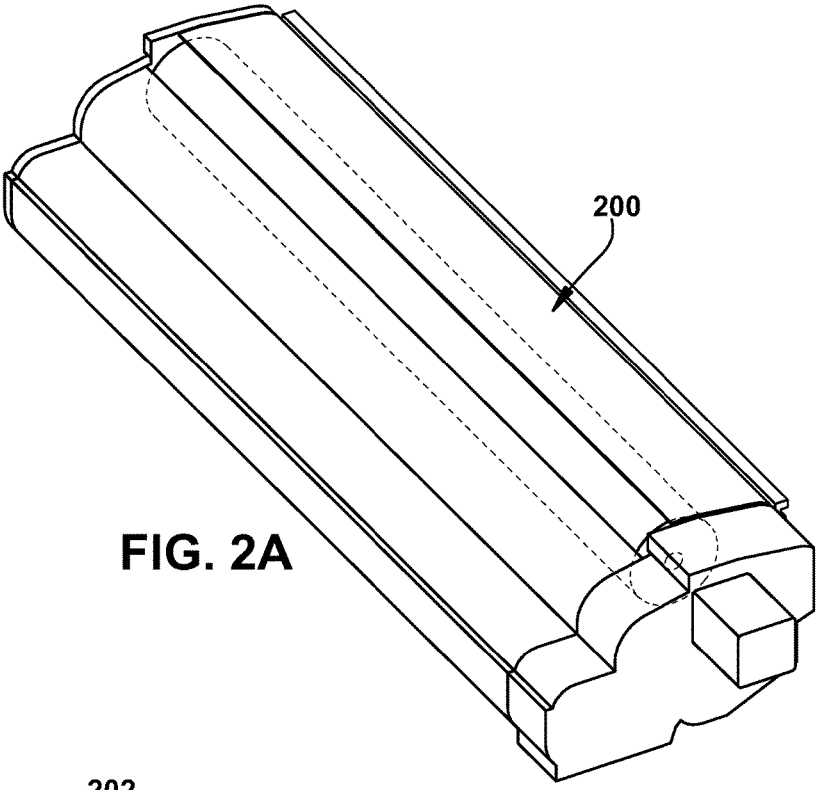
FIG. 2A is a diagram of an example electrostatic process unit.
Figure 2B:
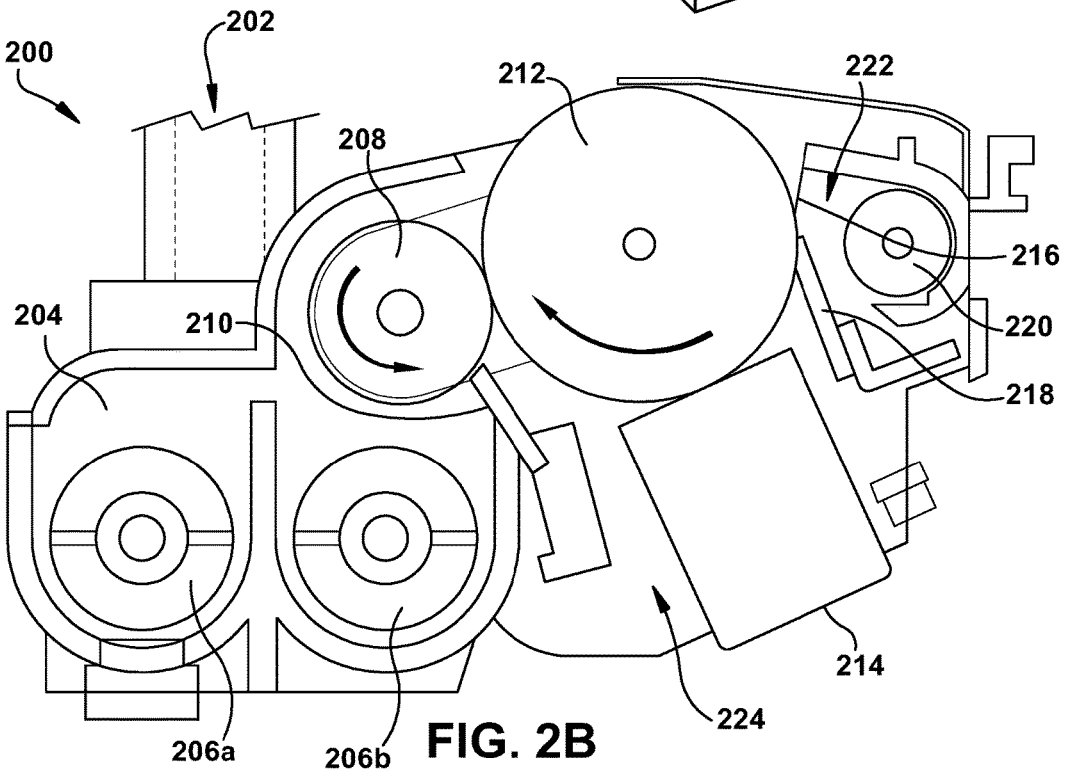
FIG. 2B is a block diagram of developer elements of an example electrostatic process unit.

With reference to FIGS. 2A and 2B, diagrams of an electrostatic process unit 200 of an example laser printer are presented. The electrostatic process unit 200 receives toner 202 into a toner hopper 204 of a developer unit that includes mixers 206*a* and 206*b*. Toner 202 from the toner hopper 204 is picked up by the developer 208 that rotates towards a doctor blade 210. The doctor blade 210 removes excess toner 202 from the developer 208 leaving a thin evenly distributed layer of toner 202 on the developer 208. The developer 208 rotates towards the photoconductive drum 212. The photoconductive drum 212 is charged by a charger unit 214 which can include a primary charge roller (not shown), and a laser (not shown) associated with the printer produces the image to be printed on the photoconductive drum 212.

As the photoconductive drum 212 rotates, toner 202 on the photoconductive drum 212 is selectively pulled from developer 208 to the photoconductive drum 212 in accordance to the image to printed. The photoconductive drum 212 transfers the toner 202 to a transfer belt (not shown) and then to paper (not shown) after which the toner 202 is permanently fused to the paper by a fusing assembly (not shown). After transferring toner 202 to the transfer belt, the photoconductive drum 212 continues to rotate towards a cleaner blade 218 that removes any residual toner and other particles that remain on the photoconductive drum 212. A recovery blade 216 prevents removed toner and other particles from escaping from this section of the developer cavity 222 into other parts of the developer cavity 224. An auger 220 moves waste toner and other particles out of the EPU to a suitable waste receptacle.

Figure 3A:
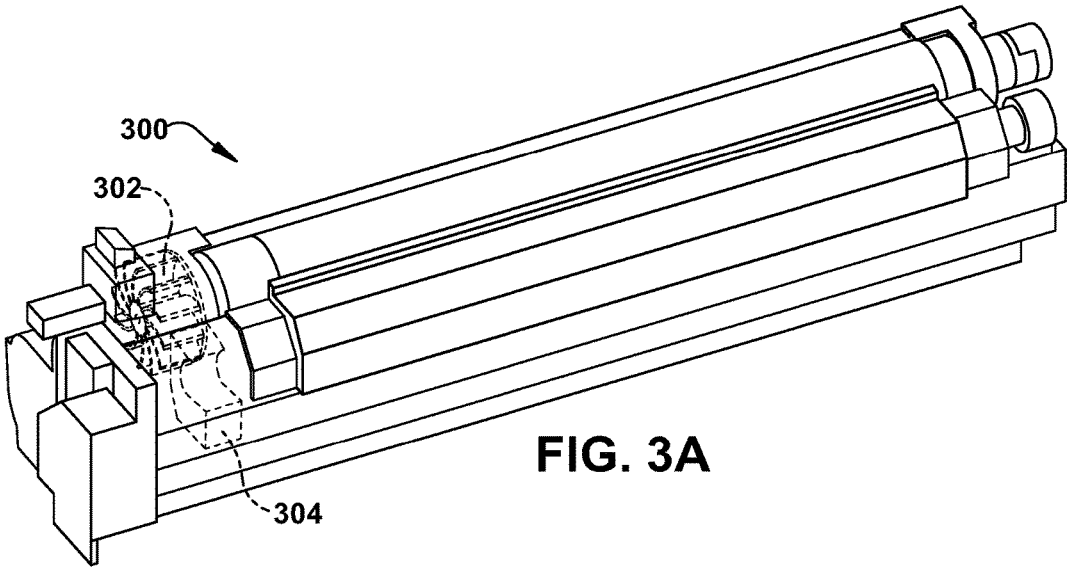
FIG. 3A is a diagram of fan placement and filter placement in an example embodiment of an electrostatic process unit with negative pressure generating elements.

With reference to FIG. 3A, a diagram of an embodiment of electrostatic process unit 300 with negative pressure generating elements is presented. A fan 302 is positioned at one end of the electrostatic process unit 300. The fan 302 is coupled to the shaft of the photoconductive drum. As the fan 302 rotates, the blades are configured to move air away from a first side of the fan, thereby lowering the pressure on a second side of the fan that is in communication with the developer cavity. An air current is generated in the developer cavity, and toner and dust suspended in the developer cavity are drawn in the volume of air in the direction of the lower pressure. Toner and paper dust that is not suspended in the air can also be drawn by the movement of the volume of air, for example into the vicinity of an auger that rotates and removes waste toner and paper dust from the electrostatic process unit 300.

In a configuration, the fan 302 is secured on the shaft so as to rotate at the same speed of the photoconductive drum. In another configuration, the fan 302 is coupled to the shaft via gears or a belt so as to rotate at a multiple of the speed of the photoconductive drum. In an embodiment, the fan 302 can be positioned in another part of the EPU or the printer, and a fan or other means of creating negative pressure can be suitably coupled to the EPU, for example using a tube or a conduit such as a plastic or metal pipe.

A filter 304 is positioned between the developer cavity of the electrostatic process unit 300 and the fan 302, or another suitable means of generating the negative pressure. The filter 304 prevents dust and toner suspended in air from escaping the developer cavity. The filter 304 and the fan 302 are in fluidic communication, meaning that air is drawn from the developer cavity through the filter 304 by the fan 302. Particles of toner and dust are thus trapped and safely removed from the developer cavity by the auger of FIG. 2B.

Figure 3B:
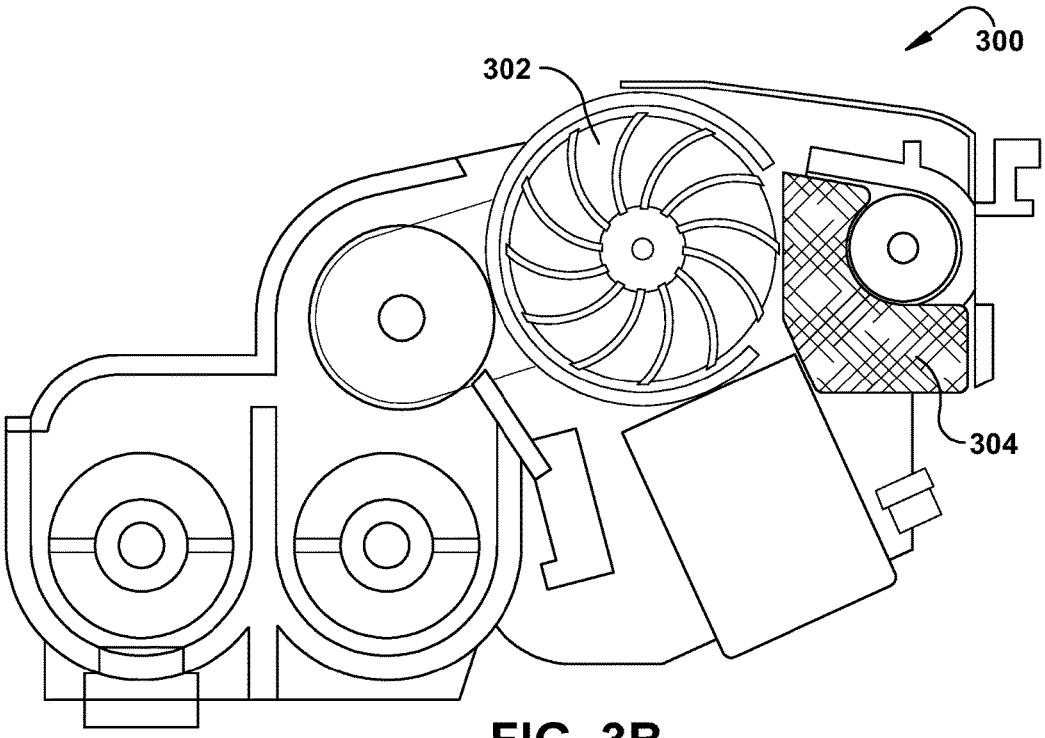
FIG. 3B is a diagram of an example embodiment of an electrostatic process unit with negative pressure generating elements.

With reference to FIG. 3B, a diagram of an embodiment of an example fan 302 and an example filter 304 of an electrostatic process unit 300 with negative pressure generating elements are presented. The fan 302 is illustrated as an axial-flow fan and includes blades configured to move air from a first side of the fan 302 to a second side of the fan 302. The first side of the fan 302 is in communication with the filter 304, for example using suitable conduits, thereby creating a negative pressure between the fan 302 and the filter 304 to draw air from the developer cavity towards the filter 304. In another embodiment, the fan 302 is a centrifugal fan, or squirrel cage. In yet another embodiment, the fan 302 can be a cross-flow or tangential fan, or any other suitable type of fan. The fan 302 can be selected based on the required performance or desired flow characteristics such as the speed or volume of the airflow. Suitable conduits can be attached between the fan 302 and the filter 304 to direct airflow.

The filter 304 is illustrated as covering a portion of the developer cavity associated with the cleaner blade and the auger. In this configuration, the filter 304 has one side open to the developer cavity and the other side is in communication with the fan 302. Toner and dust in the developer cavity move towards the filter 304, are trapped within the developer cavity by the filter 304, and accumulate at the auger which removes the toner and dust from the EPU. In other configurations, one or multiple filters 304 are coupled to other portions of the developer cavity and remove airborne particulate from those other portions of the developer cavity.

Advantageously, negative pressure generating elements such as the fan 302 and the filter 304 remove airborne particulate such as toner and paper dust from the developer cavity. Removing airborne particulate by the negative pressure generating elements substantially reduces the amount of toner spray and leakage to other parts of the EPU that are typically experienced in toner-based electrostatic print units. The negative pressure generating elements also reduce the amount of toner and dust that leak into other parts of the printer which reduces the amount of periodic maintenance required by technicians. One such example submicron particle commonly suspended inside the developer cavity is calcium carbonate which is commonly used in a wide range of papers. These particles and stray toner accumulate on charge rollers such as the photoconductive drum or other EPU components. The particles and stray toner decrease print quality, cause malfunctions, and increase maintenance needs. Therefore, removing these airborne particles and toner advantageously improves the operation of toner-based printers.

Figure 4:
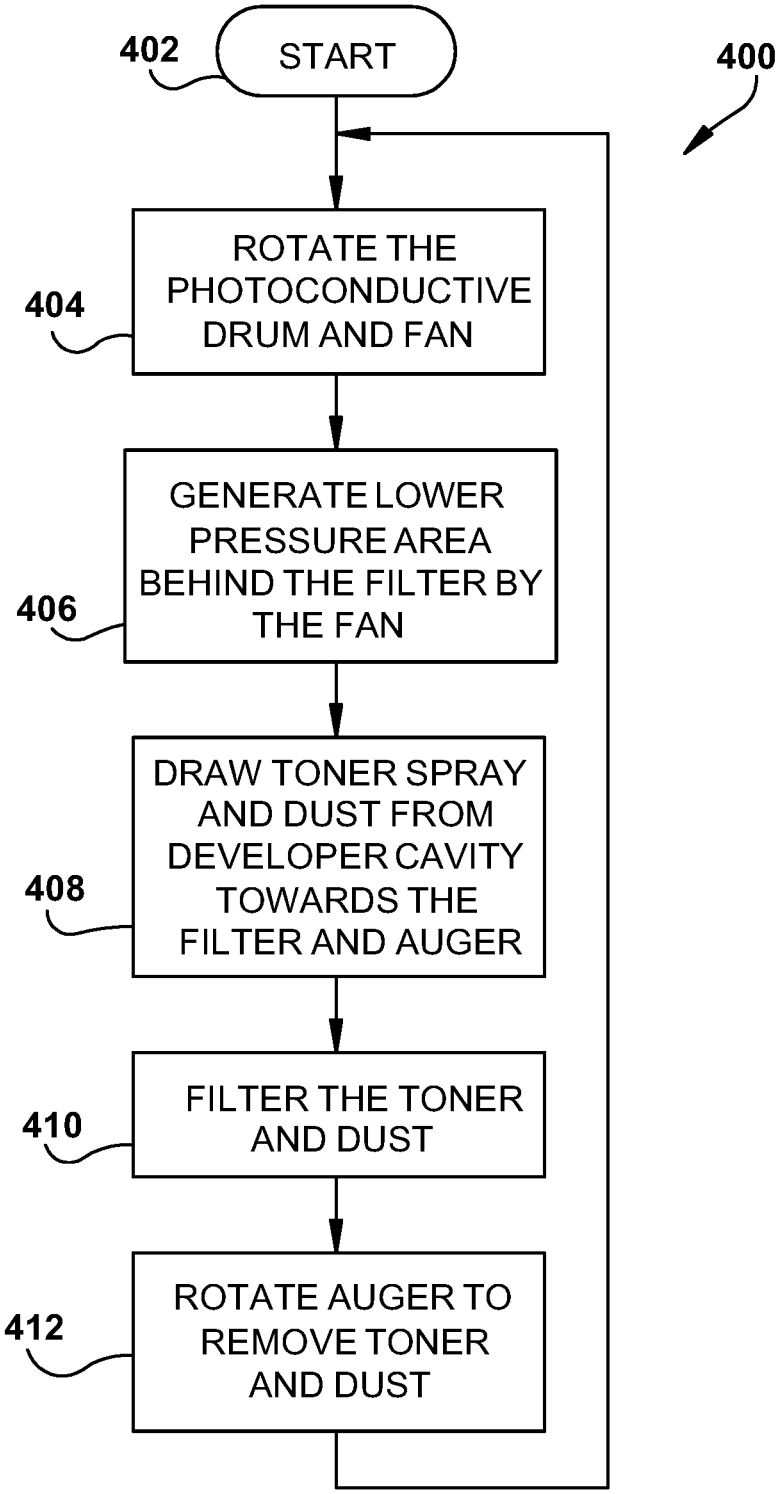
FIG. 4 is a flowchart of example operations for removing suspended toner and paper dust from developer cavities in an electrostatic process unit of a toner-based printer.

With reference to FIG. 4, an example flowchart 400 for removing particles from developer cavities of electrostatic process units is presented. Processing commences at start block 402 and proceeds to process block 404.

At process block 404, the drum assembly begins to rotate, for example to begin the process of printing a page. As the photoconductive drum rotates, a fan coupled to photoconductive drum rotates. Processing continues to process block 406.

At process block 406, as the fan rotates, an area of low pressure is generated on the side of the fan that is in fluidic communication with a filter. The filter is a permeable barrier positioned between the fan and one or more areas of the developer cavity of the ESU. A lower pressure on the fan side of the filter causes air to permeate from the developer cavity side of the filter to the fan side of the filter, thereby generating a flow of air in the developer cavity towards the filter. Processing continues to process block 408.

At process block 408, stray toner and other dust particles that are suspended in the air of the developer cavity migrate towards the filter. Toner and dust particles in the developer cavity also can be urged towards an auger disposed in the developer cavity. Processing continues to process block 410.

At process block 410, toner and dust are blocked by the filter, which allows air but not particles to pass from the developer cavity side of the filter to the fan side of the filter. Particulate trapped by the filter accumulates at the auger. Processing continues to process block 412.

At process block 412, an auger configured to remove waste toner and other particles is rotated to remove the toner and dust from the EPU into a suitable waste receptacle. Processing then returns to process block 404 while printing continues and the cycle is repeated. Processing can terminate at any suitable block, for example when the printer finishes a print job, when the printer enters a sleep or idle mode, or when the printer is turned off.

In light of the foregoing, it should be appreciated that the present disclosure significantly advances the art of removing residual toner and other particles from the photoconductive drum of a toner-based print unit. While example embodiments of the disclosure have been disclosed in detail herein, it should be appreciated that the disclosure is not limited thereto or thereby inasmuch as variations on the disclosure herein will be readily appreciated by those of ordinary skill in the art. The scope of the application shall be appreciated from the claims that follow.

What is claimed is:

1. An apparatus, comprising:

a filter having a first side coupled to at least a portion of a developer cavity of an electrostatic process unit and a second side in communication with an associated fan, the filter configured to trap particulate in the developer cavity while allowing air from the developer cavity to be drawn through the filter from the first side to the second side; and a fan coupled to a drum assembly of the electrostatic process unit and in communication with the second side of the filter, the fan configured to rotate in coordination with the drum assembly to generate low pressure on the second side of the filter to draw the air from the developer cavity through the filter.

2. The apparatus of claim 1, wherein the fan is coupled to a drive shaft of a photoconductive drum of the drum assembly.

3. The apparatus of claim 2, wherein the fan is mounted directly on the drive shaft and is coaxial with the photoconductive drum.

4. The apparatus of claim 1, wherein the fan is selected from the group consisting of an axial-flow fan, a centrifugal fan, and a cross-flow fan.

5. The apparatus of claim 4, further comprising:

a conduit configured to guide a flow of air between the fan and the filter.

6. The apparatus of claim 1, wherein the filter is configured to trap particulate selected from the group consisting of toner, paper dust, submicron particles, and particles comprising calcium carbonate.

7. The apparatus of claim 1, wherein the filter is coupled to a closed area of the developer cavity associated with a cleaner blade, a recovery blade, and an auger, and wherein the filter is further configured to deposit at least some of the trapped particulate in proximity to the auger for removal by the auger.

8. The apparatus of claim 1 wherein the electrostatic process unit includes a developer roller, a photoconductive drum, a doctor blade, and a cleaner blade.

9. The apparatus of claim 8, wherein the electrostatic process unit is coupled with an associated developer unit.

10. An electrostatic process unit, comprising:

a photoconductive drum configured to selectively attract toner from an associated developer roller and deposit substantially all of the toner selectively attracted to the photoconductive drum onto a paper;

a cleaner blade configured to electrostatically remove, from the photoconductive drum, residual toner not deposited onto the paper; and a filter having a first side displaced over at least a portion of a developer cavity of the electrostatic process unit and a second side in communication with a negative pressure generating element, the filter configured to trap particulate in the developer cavity while allowing air from the developer cavity to be drawn through the first side of the filter by a negative pressure on the second side of the filter.

11. The electrostatic process unit of claim 10, wherein the filter is configured to trap particulate selected from the group consisting of toner, paper dust, submicron particles, and particles comprising calcium carbonate.

12. The electrostatic process unit of claim 10, further comprising:

a fan coupled to the photoconductive drum and in communication with the second side of the filter, the fan configured to rotate in coordination with the photoconductive drum to generate negative pressure on the second side of the filter to draw air from the developer cavity through the filter.

13. The electrostatic process unit of claim 12, wherein the fan is mounted directly on a drive shaft associated with the photoconductive drum and is coaxial with the photoconductive drum.

14. The electrostatic process unit of claim 12, wherein the fan is selected from the group consisting of an axial-flow fan, a centrifugal fan, and a cross-flow fan.

15. The electrostatic process unit of claim 12, further comprising:

a conduit configured to guide a flow of air between the fan and the filter.

16. The electrostatic process unit of claim 10, further comprising:

a recovery blade configured to substantially trap the residual toner removed from the photoconductive drum by the cleaner blade in a closed portion of the developer cavity; and an auger configured to remove the trapped toner from the electrostatic process unit, wherein the filter is coupled only to the closed portion of the developer cavity, and wherein the filter is further configured to deposit at least some of the trapped toner in proximity to the auger for removal by the auger.

17. A method, comprising:

applying a negative pressure to a filter displaced over at least a portion of a developer cavity of an electrostatic process unit;

drawing, through the filter, a volume of air containing suspended particulate from a portion of the developer cavity adjacent to the filter; and filtering the suspended particulate from the volume of air by the filter.

18. The method of claim 17, further comprising:

rotating a photoconductive drum of the electrostatic process unit; and rotating, as a result of rotating the photoconductive drum, a fan configured to generate the negative pressure applied to the filter.

19. The method of claim 18, wherein the fan is mounted coaxially with the photoconductive drum on an associated drive shaft.

20. The method of claim 18, further comprising:

rotating an auger associated with the electrostatic process unit to remove particulate from the developer cavity.

* * * * *